United States Patent [19]

Weisberg

[11] 4,179,027

[45] Dec. 18, 1979

[54] HIGH IMPACT STRENGTH PARTIALLY LIQUID FILLED BAG

[76] Inventor: Warren Weisberg, 1048 Judson Ave., Evanston, Ill. 60202

[21] Appl. No.: 936,214

[22] Filed: Aug. 24, 1978

[51] Int. Cl.[2] ..... B65D 85/30

[52] U.S. Cl. ..... 206/205; 206/525; 220/88 R; 222/187

[58] Field of Search ..... 206/525, 526, 527, 205, 206/210; 222/187; 220/88 R

[56] References Cited

U.S. PATENT DOCUMENTS

| | | | |
|---|---|---|---|
| 2,613,862 | 10/1952 | Vaughn | 206/205 |
| 3,708,330 | 1/1973 | Harr | 220/88 R |
| 3,917,116 | 11/1975 | Mason | 222/187 |

*Primary Examiner*—William T. Dixson, Jr.

*Attorney, Agent, or Firm*—Wallenstein, Spangenberg, Hattis & Strampel

[57] ABSTRACT

A high impact strength, flexible bag comprises a bag formed from spaced confronting walls of flexible sheet material joined together at the margins thereof to form a sealed enclosed space only partially filled with a liquid which is to be dispensed from the bag. There is immersed in the body of the liquid within the bag an open-cellular compressible body which extends throughout most of the liquid in the bag when the bag is lying on a horizontal support surface. The structure defining the open cells of the compressible body form such a substantial obstruction to the outward flow of liquid in the bag when a sudden external force is applied to the bag that the liquid therein cannot flow outward to rupture the bag walls.

3 Claims, 6 Drawing Figures

HIGH IMPACT STRENGTH PARTIALLY LIQUID FILLED BAG

BACKGROUND OF THE INVENTION

The present invention relates to the packaging of liquid materials in flexible bags made of synthetic plastic sheet material formed into flat bags comprising relatively closely spaced confronting walls joined and sealed together at the margins thereof to form a sealed enclosed space.

Flat flexible bags are used for packaging liquid or solid materials. When holding liquid materials such a bag may be so completely filled with a liquid that the walls thereof are bulged by the liquid for all orientations of the bag. In other cases, when the bag is partially filled with liquid when held upright, it may act as a filled bag when lying horizontally, since the volume of the space in such a bag is much less when the bag lies flat on a horizontal support surface where gravity causes the walls thereof to be more closely spaced than when the bag is held upright. The bag walls are then bulged outwardly by the volume of the liquid therein. In both cases, the bags must be made of sufficient strength that when packed one above the other in boxes for storage or shipment, they can support the weight of the maximum possible number of bags which may be stacked above the same without rupturing under the weight involved. The force applied to the walls of a bag in such a box is, in part, dependent on the weight of the liquid in each bag and the number of bags which are stacked above it. Normally, these bags readily can withstand these forces. However, these forces are increased manyfold when the box is dropped inadvertently upon a floor, for example, at a height of several feet and not infrequently the lowermost bags in the box rupture under the forces involved. To avoid this problem, the bags must be made of such thick sheet stock that the cost of the bags becomes excessive.

It is, accordingly, an object of the invention materially to increase the rupture strength of flat bags as described without the need of increasing the thickness of the bag walls, so that the bags can withstand the substantial impact forces applied thereto when they constitute the bottommost bags in boxes which may be dropped inadvertently upon the floor.

Another object of the invention is to provide a flexible bag as described wherein the liquid contents of the bag can be quickly and easily poured from the bag without requiring any squeezing of the bag in the process of pouring the liquid from the bag.

A further object of the invention is to provide a partially filled bag as described wherein the bag per se is a conventionally constructed inexpensive bag with a wall thickness which normally would pose a risk of rupturing under the circumstances described.

To my knowledge, the prior art has not developed flat flexible bags satisfying these objectives. U.S. Pat. No. 3,433,353 discloses a container made from relatively thick thermoplastic-sheet stock which is shaped in such a way as to maximize the impact strength of the container when dropped from considerable heights. U.S. Pat. No. 3,340,669 discloses a flat flexible bag of a special configuration for protecting frangible articles. The bags or containers disclosed in these patents are of complex and expensive construction and do not satisfy the objectives of the present invention.

SUMMARY OF THE INVENTION

The present invention provides a unique way of increasing the impact strength of inexpensive conventional bags made of flexible sheet material for holding liquid materials to be dispensed in the case where the bags need only be modestly partially filled with liquid when held in their upright positions.

In accordance with the most preferred form of the invention, there is placed in a conventional flat flexible bag as described an open-cellular compressible body, such as one produced by foaming synthetic plastic materials. The open-cellular body extends throughout most of the liquid in the bag when the bag is lying flat on a horizontal support surface. It is crucial to the operability of the invention that when the bag is lying flat on a horizontal support surface, the body of liquid therein does not apply bag-bulging forces to the walls of the bag (i.e. so that the bag does not act as a filled bag). With such a partially filled bag, external impact forces present under the circumstances described reduce the pressures involved on the bag walls since outward flow of the liquid is hindered substantially by the randomly located mis-aligned cell-forming structures forming the open cellular body In the preferred form of the invention the cells of the cellular body are formed by thin, inter-linked filaments of the synthetic plastic material involved, rather than by more extensive wall surfaces found in washing sponges which absorb and retain liquid within the cells, so that the body must be squeezed to disperse the liquid therein. With the open cellular body made of such inter-linked filaments, the liquid rapidly flows from the bag without the need for squeezing the same when the upper margin of the bag is opened to form a pouring opening therein.

It should be emphasized by stating again that if the bag were filled with liquid while lying flat, so that the open-cellular compressible body were floating in the liquid involved, any impact force suddenly applied to the bag would immediately cause the incompressible liquid to communicate the pressure applied to the liquid to all portions of the bag, without any flow of liquid taking place, and the open-cellular compressible body within the bag would in such case serve no useful purpose.

The present invention is to be contrasted further, for example, from the subject matter of U.S. Pat. No. 2,613,487 to Vaughn, wherein there disclosed a method of packaging washing sponges by injecting the same with a sufficient amount of water to keep the sponge in a softened condition. Not only is the sponge disclosed in this patent unsatisfactory for use in the present invention, particularly since it would hinder the free pouring of liquid from the bag if the bag were filled with liquid, but the amount of liquid which is needed to keep the sponge soft is obviously not liquid to be dispensed, and so this patent is not pertinent to the present invention, namely, to a bag partially filled with liquid to be dispensed and wherein the open-cellular compressible body is immersed (but not floating) in the liquid involved when the bag is lying on a horizontal surface.

The above described and other features, objects and advantages of the invention will become apparent on making reference to the specifications to follow, the claims and the drawings.

DESCRIPTION OF PREFERRED EMBODIMENT OF THE INVENTION

Figure 1:
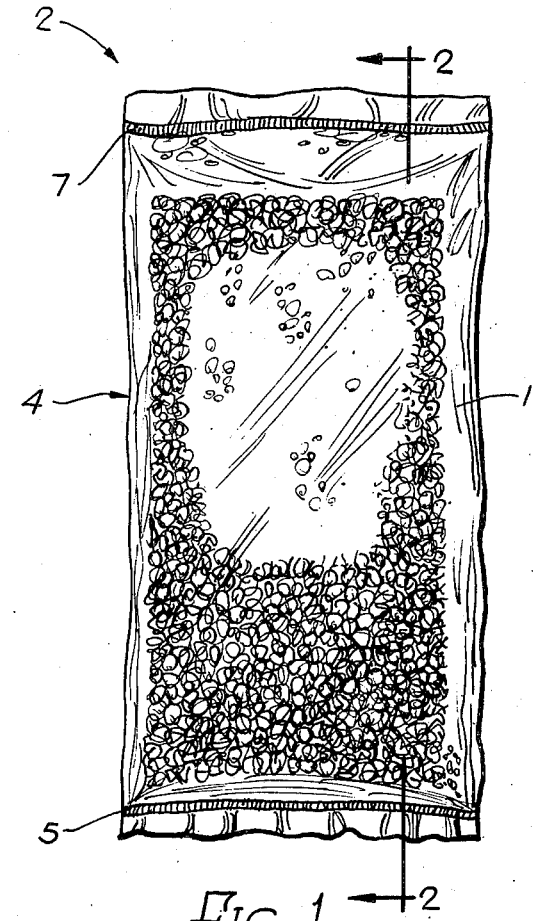
FIG. 1 is an elevational view of the invention, and shows a partially liquid filled bag of the invention suspended in a vertical position.

Referring now to the drawings, which show a preferred form of flat, flexible, liquid filled bag 2 incorporating the features of the invention, this bag is shown formed from an extruded tube of synthetic plastic material which is flattened and then initially sealed at one end along a seal line 5 thereat. Such a bag has closely confronting rectangular walls 4*a*–4*b* joined together at the longitudinal margins thereof. The bag contains an open-cellular compressible body 6 extending throughout most of the liquid 8 therein to be dispensed. After the bag is partially filled with liquid, the uppermost portion thereof is then sealed along the seal line 7, completely to seal the liquid 8 of the bag from the surrounding atmosphere.

Figure 2:
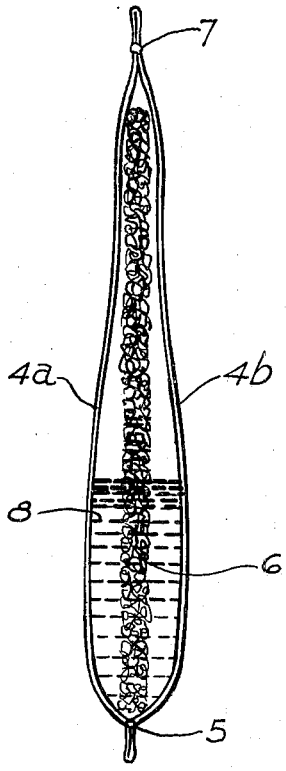
FIG. 2 is an end elevational view of the bag shown in FIG. 1, taken along the line 2—2 looking in the direction of the arrows.
Figure 3:
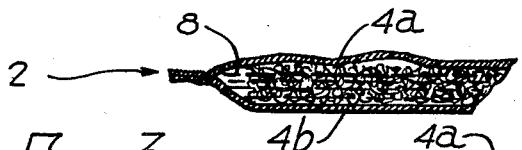
FIG. 3 is a cut away sectional view of the bag shown in FIG. 1 when it is lying in a normal storage position upon a horizontal surface.

When the bag is suspended in a vertical position as shown in FIGS. 1 and 2, the body of liquid 8, while only partially filling the bag, bulges the bottom portion of the bag 4 to increase the volume thereof to a point where it occupies approximately only the bottom half of the bag. When, however, the bag is laid on a flat horizontal surface, as shown in FIG. 3, the liquid 8 only partially fills the bag so that the compressible body therein is immersed in most of the liquid but is not floating therein. In such case, the liquid does not bulge the walls of the bag. Also, in this position the liquid preferably occupies substantially most of the volume of the bag interior, so that only a small bag space is wasted when the bag is in this position, which is its normal position for shipment and storage thereof.

Figure 4:
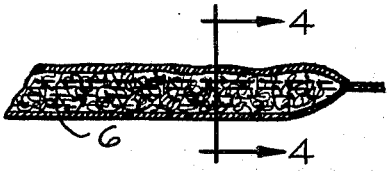
FIG. 4 is an enlarged transverse sectional view through the partially liquid filled bag of FIG. 3, taken along section line 4—4 therein looking in the direction of the arrows.
Figure 4:
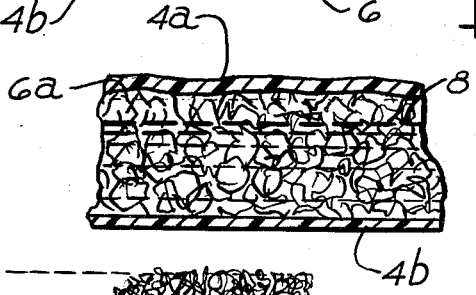
Figure 5:
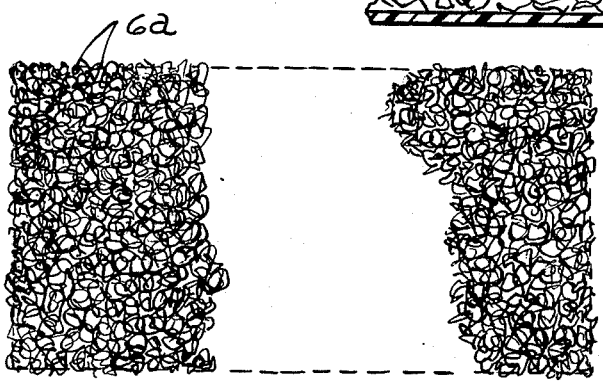
FIG. 5 is a plan view of the open-cellular compressible body used within the bag shown in FIGS. 1 through 4.

While not required by the broadest aspect of the invention, the open-cellular compressible body 6 is preferably made by foaming a synthetic plastic material in a manner to form the randomly positioned open cells defined by thin inter-linked filaments 6*a* (FIG. 4) which are out of alignment, so that when the compressible body is viewed longitudinally one cannot see through the body because of the multiplicity of misaligned filaments. Also in the most preferred form of the invention, the actual volume of the bag interior occupied by the filaments of the open-cellular compressible body 6 is most advantageously much less than 10%, and preferably less than 5% of the volume thereof. When the margins of the open cells are defined by the filaments, the cells do not absorb liquid, as in the case of conventional washing sponges made of open-cellular foam, so that, when the bag is severed across the corner thereof to form a pouring spout, the liquid can be rapidly poured from the bag without the necessity for squeezing the compressible body 6. (However, the broadest aspect of the invention is applicable to a bag having an open-cellular compressible body which absorbs liquid to a greater extent than when it is formed by its thin, interlinked filaments as shown in the drawings.)

Figure 6:
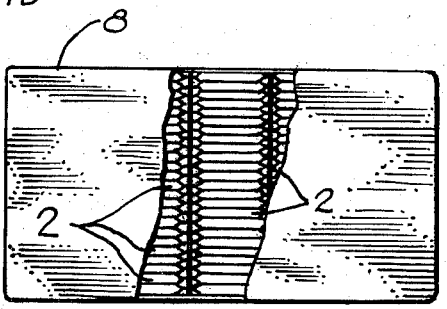
FIG. 6 is a view of a box holding a large number of the bags shown in FIGS. 1 through 5.

The filaments 6*a*, or other cell-defining structures of the open-cellular body used in the invention, act as substantial obstructions to the sudden flow of liquid in all directions, so that a force suddenly applied to the partially liquid filled bag as it is lying on a horizontal support surface will initially partially collapse the compressible body 6 and increase the density thereof, where the filaments hinder to a maximum degree any sudden outward flow of liquid. In the absence of such an open-cellular compressible body as described (or in the presence of such a body in a filled bag) a sudden application of force to the bag caused, for example, by dropping a box 8 (FIG. 6) of such bags from a height of several feet upon the floor, can readily cause pressure against the bag walls of the bottommost bags and the box which can rupture the same.

It should be noted that the compressible body does not render the bag 2 rupture-proof by virtue of the fact that it is compressible and absorbs part of the impact forces, but rather by virtue of the fact that the misaligned cell-defining structures thereof offer a substantial obstruction to the sudden flow of liquid in a partially filled bag. This concept is believed to be unique in liquid filled bags.

I claim:

1. In combination: a completely sealed, rupture-proof, flat flexible bag comprising relatively closely spaced confronting walls of a flexible sheet material sealed together at contacting confronting peripheral surfaces thereof to form a sealed enclosed space which is opened only by severing a portion of the bag, said bag walls being so flexible as to collapse inwardly into contiguous relation when otherwise unsupported and lying flat on a horizontal support surface; an open-cellular compressible body in said space and extending for most of the length of the bag, a liquid to be dispensed in said space and immersing said body so as to be pourable from the bag but which at all times only partially fills the unoccupied space in the bag whether the bag is oriented vertically or horizontally, so that when the bag is lying on a horizontal support surface the liquid therein still only initially fills the same so that the walls of the bag are not bulged thereby; and the cell-defining structure of said open-cellular compressible body providing a multitude of misaligned cell-defining structures which form numerous obstructions to the flow of the liquid in a direction parallel to the confronting walls thereof when the bag is supported on a horizontal support surface, so that when an impact force is than externally applied to the bag the liquid will not flow outwardly with a force which can rupture the bag.

2. The combination of claim 1 wherein the cell-defining structure of the cells of said compressible body comprises relatively thin inter-linked filaments of material which, while causing obstructions to the sudden flow of liquid as described, nevertheless permit the liquid in the bag to be rapidly poured therefrom without the need to squeeze said body when the bag is opened at one end and the liquid is poured therefrom.

3. In combination, a container, a large number of flat flexible bags partially filled with liquid and lying on their sides one above the other therein, and each of said bags comprising relatively closely spaced confronting walls of a flexible sheet material sealed together at contacting confronting peripheral surfaces thereof to form a sealed enclosed space which is opened only by severing a portion of the bag, said bag walls being so flexible as to collapse inwardly into contiguous relation when otherwise unsupported and lying flat on a horizontal support surface; an open-cellular compressible body in said space and extending for most of the length of the bag; a liquid to be dispensed in said space and immersing said body, so as to be pourable from the bag but which at all times only partially fills the unoccupied space in the bag whether the bag is oriented vertically or horizontally, so that when the bag is lying on a horizontal support surface the liquid therein still only initially fills the same so that the walls of the bag are not bulged thereby; and the cell-defining structure of said open-cellular compressible body providing a multitude of misaligned cell-defining structures which form numerous obstructions to the flow of the liquid in a direction parallel to the confronting walls thereof when the bag is supported on a horizontal support surface, so that when an impact force is than externally applied to the bag the liquid will not flow outwardly with a force which can rupture the bag.

* * * * *